US009518234B2

(12) United States Patent
Boe

(10) Patent No.: US 9,518,234 B2
(45) Date of Patent: *Dec. 13, 2016

(54) METHODS AND SYSTEMS FOR CONVERTING PETROLEUM BASED OIL INTO FUEL

(71) Applicant: OTG RESEARCH, LLC, Lone Tree, CO (US)

(72) Inventor: Philip Allen Boe, Lone Tree, CO (US)

(73) Assignee: OTG Research, LLC, Lone Tree, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/729,516

(22) Filed: Jun. 3, 2015

(65) Prior Publication Data

US 2016/0017241 A1 Jan. 21, 2016

Related U.S. Application Data

(60) Continuation of application No. 14/319,951, filed on Jun. 30, 2014, now abandoned, which is a division of (Continued)

(51) Int. Cl.
*C10G 57/00* (2006.01)
*C10G 9/04* (2006.01)

(Continued)

(52) U.S. Cl.
CPC ..... *C10G 57/00* (2013.01); *C10G 9/04* (2013.01); *C10G 17/06* (2013.01); *C10G 29/22* (2013.01);

(Continued)

(58) Field of Classification Search
None
See application file for complete search history.

(56) References Cited

U.S. PATENT DOCUMENTS 2,474,411 A 6/1949 Bersworth et al.
3,124,525 A 3/1964 Remonte (Continued)

FOREIGN PATENT DOCUMENTS

EP 0236021 9/1987
JP 2006249419 9/2006

(Continued)

OTHER PUBLICATIONS

Noureddini et al., "Kinetics of Transesterification of Soybean Oil," JAOCS, vol. 74, No. 11 (1997); p. 1458, col. 1, paragraph 3; p. 1458, col. 2., paragraph 2; Fig. 3); retrieved from http://journeytofoever.org/biofuel_library/kinetics.pdf on Mar. 6, 2013.

(Continued)

*Primary Examiner* — Tam M Nguyen
(74) *Attorney, Agent, or Firm* — Christopher P. Whitham; Cochran Freund & Young LLC

(57) ABSTRACT

Methods and systems for converting petroleum based oil into fuel generally include forming a conversion mixture of an alcohol and a base, adding the conversion mixture to petroleum based oil (such as crude oil, used oil, used motor oil, and new motor oil) to form a reaction mixture, adding a high nitrate compound and an amino acid the reaction mixture, ozonizing the reaction mixture. The result may include a three phase system in which the bottom phase is asphalt oil, the middle phase is diesel fuel or jet fuel, and the top phase is sulfuric acid. The three phases may be separated to obtain the final diesel fuel or let fuel product. Additional cooling and/or filtering processes may be utilized to complete and/or optimize oil conversion.

20 Claims, 3 Drawing Sheets

Related U.S. Application Data application No. 13/862,363, filed on Apr. 12, 2013, now Pat. No. 8,859,833, which is a continuation-in-part of application No. 13/445,738, filed on Apr. 12, 2012, now Pat. No. 8,492,601.

(60) Provisional application No. 61/474,502, filed on Apr. 12, 2011.

(51) Int. Cl.

| | |
|---|---|
| ***C10G 17/06*** | (2006.01) |
| ***C10G 29/22*** | (2006.01) |
| ***C10G 51/00*** | (2006.01) |
| ***C10L 1/04*** | (2006.01) |
| ***C10L 1/08*** | (2006.01) |
| ***C10M 175/00*** | (2006.01) |

(52) U.S. Cl.

CPC ..... *C10G 51/00* (2013.01); *C10L 1/04* (2013.01); *C10L 1/08* (2013.01); *C10M 175/0016* (2013.01); *C10M 175/0058* (2013.01); *C10G 2300/1007* (2013.01); *C10G 2400/04* (2013.01); *C10L 2200/043* (2013.01); *C10L 2200/0446* (2013.01); *C10L 2270/026* (2013.01); *C10L 2270/04* (2013.01); *C10L 2290/06* (2013.01); *C10L 2290/24* (2013.01)

(56) References Cited

U.S. PATENT DOCUMENTS

| | | | | |
|---|---|---|---|---|
| 5,424,467 | A | 6/1995 | Bam et al. | |
| 6,364,917 | B1 * | 4/2002 | Matsumura | C10L 1/026 44/301 |
| 7,497,939 | B2 | 3/2009 | Matsumura et al. | |
| 8,492,601 | B1 * | 7/2013 | Boe | C10G 53/14 208/179 |
| 8,859,833 | B2 | 10/2014 | Boe | |
| 9,006,504 | B2 | 4/2015 | Boe | |
| 2001/0020344 | A1 | 9/2001 | Thompson et al. | |
| 2001/0042340 | A1 | 11/2001 | Tateno et al. | |
| 2003/0167681 | A1 * | 9/2003 | Delgado Puche | C10L 1/026 44/388 |
| 2007/0113467 | A1 | 5/2007 | Abou-Nemeh | |
| 2008/0171889 | A1 | 7/2008 | Chen et al. | |
| 2011/0306101 | A1 * | 12/2011 | De Crecy | C12P 7/6409 435/134 |
| 2013/0274530 | A1 * | 10/2013 | Boe | C10G 57/00 585/310 |

FOREIGN PATENT DOCUMENTS

| | | |
|---|---|---|
| SU | 1442537 | 12/1988 |
| WO | 9411471 | 5/1994 |
| WO | 2007068800 | 6/2007 |

OTHER PUBLICATIONS

International Search Report and Written Opinion in PCT Application Serial No. PCT/US13/21467, mailed Mar. 28, 2013.

Noureddini et al., "Densities of Vegetable Oils and Fatty Acids," University of Nebraska—Lincoln, Chemical and Biomolecular Engineering Research and Publications, Dec. 1, 1992.

International Search Report and Written Opinion in PCT Application Serial No. PCT/US13/026503, mailed Aug. 20, 2013.

Non-Final Office Action mailed Jan. 18, 2013 in U.S. Appl. No. 13/445,738, filed Apr. 12, 2012.

Non-Final Office Action mailed Jul. 15, 2014 in U.S. Appl. No. 13/939,129, filed Jul. 10, 2013.

Non-Final Office Action mailed Dec. 3, 2014 in U.S. Appl. No. 14/319,951, filed Jun. 30, 2014.

European Supplementary Search Report, mailed Aug. 28, 2015, in EP Application No. 13775645.8.

* cited by examiner

| | 700 N-m | | | | Max Torque | | | |
|---|---|---|---|---|---|---|---|---|
| | Baseline Diesel | Syn-Diesel | Baseline JP-8 | Syn Jet A | Baseline Diesel | Syn-Die- | Base-line | Syn Jet A |
| Fuel Flow (kg/hr) | 25.1 | 25.3 | 24.6 | 25.1 | 35.1 | 35.4 | 34.6 | 34.8 |
| Engine Speed (RPM) | 1700 | 1700 | 1700 | 1700 | 1700 | 1700 | 1700 | 1700 |
| Engine Load (Nm) | 710 | 714 | 699 | 709 | 999 | 1001 | 988 | 990 |
| Brake Power (kW) | 126 | 127 | 124 | 126 | 178 | 178 | 176 | 176 |
| BSFC (g/kW-hr) | 198.9 | 198.9 | 197.5 | 199.2 | 197.1 | 198.8 | 197.0 | 197.7 |
| Emissions | | | | | | | | |
| THC (ppm) | | | | | | | | |
| O2 (%) | 72.0 | 63.9 | 63.0 | 61.3 | 67.4 | 61.9 | 64.8 | 65.0 |
| CO2 (%) | 8.31 | 8.71 | 8.86 | 8.75 | 7.07 | 7.06 | 7.42 | 7.52 |
| CO (ppm) | 9.14 | 8.87 | 8.65 | 8.76 | 10.00 | 10.06 | 9.65 | 9.72 |
| NOx (ppm) | 167 | 149 | 114 | 114 | 209 | 227 | 165 | 179 |
| | 741 | 713 | 722 | 743 | 900 | 901 | 908 | 897 |
| Brake Specific Emissions | | | | | | | | |
| NOx (g/kw-hr) | | | | | | | | |
| CO (g/kw-hr) | 5.384 | 5.338 | 5.507 | 5.635 | 5.916 | 5.942 | 6.185 | 6.090 |
| HC (g/kw-hr) | 0.469 | 0.435 | 0.333 | 0.333 | 0.755 | 0.817 | 0.609 | 0.660 |
| CO2 (g/kw-hr) | 0.182 | 0.166 | 0.167 | 0.162 | 0.154 | 0.142 | 0.153 | 0.153 |
| | 635.0 | 634.9 | 630.6 | 636.1 | 628.9 | 634.4 | 628.8 | 631.0 |

FIGURE 2

METHODS AND SYSTEMS FOR CONVERTING PETROLEUM BASED OIL INTO FUEL

CROSS-REFERENCE TO RELATED APPLICATIONS

This application is a continuation of U.S. patent application Ser. No. 14/319,951 now abandoned, which application is a divisional application of U.S. patent application Ser. No. 13/862,363, filed Apr. 12, 2013, now U.S. Pat. No. 8,859,833, issued Oct. 14, 2014, which application is a continuation-in-part of U.S. patent application Ser. No. 13/445,738, filed Apr. 12, 2012, now U.S. Pat. No. 8,492,601, issued Jul. 23, 2013, which application claims priority to U.S. Provisional Patent Application No. 61/474,502, filed Apr. 12, 2011, the entirety of which are hereby incorporated by reference.

BACKGROUND

The re-use of used motor oil has traditionally been limited to the burning of used motor oil in factories or manufacturing plants as a means to generate heat and/or fire boilers. However, recent changes by the U.S. Environmental Protection Agency to the rules governing the burning of used motor oil have severely restricted this practice. As a result, much of the used motor oil previously burned now must be disposed of as waste or repurposed in some other way.

Some attempts have been made to convert the used motor oil into higher grade fuels. This typically includes attempts to "re-crack" the used motor oil in a refinery system or chemically change the oil by adding various reactants. Neither method has proven to be economically viable and/or to produce sufficient amounts of higher grade fuels.

SUMMARY

Disclosed are embodiments of methods and systems for converting petroleum based oil into fuel.

An embodiment of the present invention may comprise a method for converting petroleum based oil to diesel fuel or let fuel, the method comprising: mixing an alcohol and a base to form a conversion mixture, the base being a base suitable for weakening and/or breaking bonds in hydrocarbon chains of the petroleum based oil and which cancels out acidic components of the motor oil; adding the conversion mixture to the petroleum based oil to form a reaction mixture; heating the reaction mixture to a temperature of between 200° F. and 400° F. for a period of at least 1 hour, cooling the reaction mixture to a temperature less than 70° F.; adding a high nitrate compound to the reaction mixture; adding an amino acid to the reaction mixture; ozonizing the reaction mixture; and separating the reaction into sulfuric acid, diesel fuel or jet fuel, and asphalt oil.

An embodiment of the present invention may further comprise a system for converting petroleum based oil, the system comprising: means for mixing an alcohol and a base to form a conversion mixture, the base being a base suitable for weakening and/or breaking bonds in hydrocarbon chains of the petroleum based oil and which cancels out acidic components of the motor oil; means for adding the conversion mixture to the petroleum based oil to form a reaction mixture; means for heating the reaction mixture to a temperature of between 200° F. and 400° F. for a period of between 1 hour and 3 hours; means for cooling the reaction mixture to a temperature less than 70° F.; means for adding a high nitrate compound to the reaction mixture; means for adding an amino acid to the reaction mixture; means for ozonizing the reaction mixture; and means for separating the reaction mixture into sulfuric acid, diesel fuel or let fuel, and asphalt oil.

It is to be understood that the foregoing is a brief summary of various aspects of some disclosed embodiments. The scope of the disclosure need not therefore include all such aspects or address or solve all issues noted in the Background above. In addition, there are other aspects of the disclosed embodiments that will become apparent as the specification proceeds.

Thus, the foregoing and other features, utilities, and advantages of the subject matter described herein will be apparent from the following more particular description of certain embodiments as illustrated in the accompanying drawings. In this regard, it is therefore also to be understood that the scope of the invention is to be determined by the claims as issued and not by whether given subject includes any or all features or aspects noted in this Summary or addresses any issues noted in the Background.

BRIEF DESCRIPTION OF THE DRAWINGS

The preferred and other embodiments are disclosed in association with the accompanying drawings in which:

FIG. 2 is a chart summarizing the results of diesel engine testing carried out on diesel fuel and jet fuel produced by embodiments of methods and/or systems described herein.

DETAILED DESCRIPTION

Figure 1:
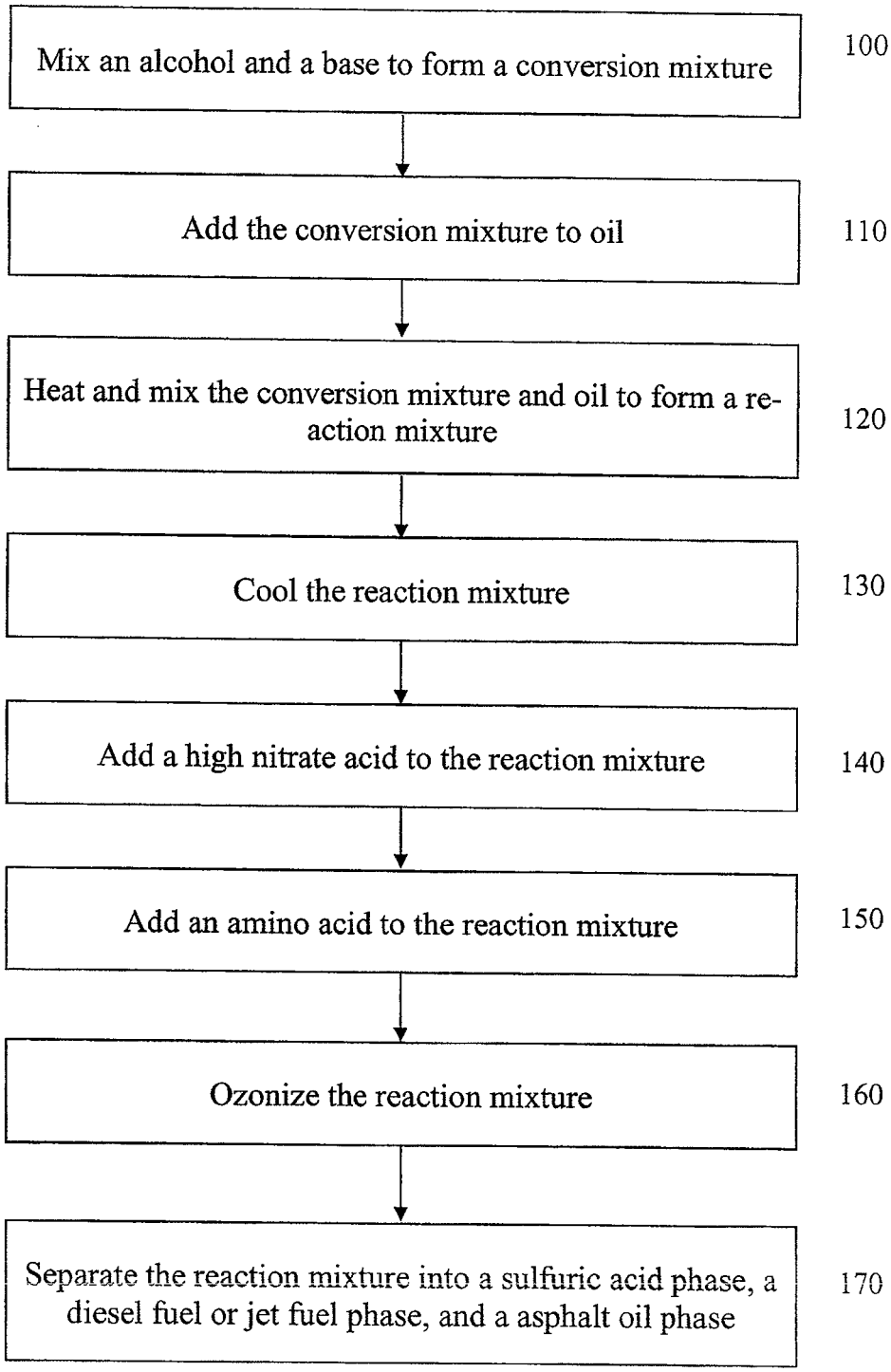
FIG. 1 is a flow chart detailing embodiments of a method for converting oil into diesel fuel or jet fuel as disclosed herein.

With reference to FIG. 1, embodiments of a method for converting petroleum based oil into diesel fuel or jet fuel may include a process 100 of mixing an alcohol and a base to form a conversion mixture, a process 110 of adding the conversion mixture to oil, a process 120 of heating and mixing the conversion mixture and oil to form a reaction mixture, a process 130 of cooling the reaction mixture, a process 140 of adding a high nitrate compound to the reaction mixture, a process 150 of adding an amino acid to the reaction mixture, a process 160 of ozonizing the reaction mixture, and a process 170 of separating the reaction mixture into a sulfuric acid phase, a diesel fuel or jet fuel phase, and a asphalt oil phase. For the embodiments disclosed herein, used oil may be the oil chosen for processing, but the oil processed by the various embodiments may be one or a combination of petroleum based oil, crude oil, used oil, used motor oil, and new motor oil. When referring to oil herein it is with regard to petroleum based oil and not vegetable oils and/or other non-petroleum based oils.

In process 100, the conversion mixture is produced. Production of the conversion mixture generally includes mixing an alcohol and a base until the base is fully dissolved in the alcohol. Any method of mixing these two components can be used provided that the base fully dissolves in the alcohol. Similarly, any suitable mixing apparatus can be used for mixing the two components. Heat can be applied to the mixture during mixing as a means of promoting the dissolution of the base in the alcohol. If heat is added to promote dissolution, the conversion mixture should be allowed to cool back to room temperature before being added to the oil in process 110.

The alcohol used in process 100 can generally include any alcohol suitable for serving as a carrier for the base and in which the base can be fully dissolved. In some embodiments, the alcohol is methanol, ethanol, t-butanol, isopropanol, or butanol, or any combination thereof. In some embodiments, the alcohol is mixed with benzene.

The base used in process 100 can generally include any base suitable for weakening and/or breaking the bonds in the hydrocarbon chains of the oil and which cancels out acidic components of the petroleum based oil. In some embodiments, the base is soda ash, sodium carbonate, sodium hydroxide, baking soda, potassium hydroxide, or any combination thereof.

In some embodiments, the conversion mixture includes from 65 wt % to 90 wt % alcohol and from to wt % to 35 wt % base. In a preferred embodiment, the conversion mixture includes from 75 to 85 wt % alcohol and from 15 to 25 wt % base.

In some embodiments, the conversion mixture will be screened or filtered after the base has fully dissolved in the alcohol in order to remove any small particulates, such as metal filings, dried oil chunks, dirt, and miscellaneous deposits. Any method of screening or filtering can be used, and the screening or filtering will generally aim to remove any particulate having a size greater than 3 microns. The screening or filtering process is carried out before the conversion mixture is added to the oil.

In process 110, the conversion mixture is added to oil. Any manner of adding the conversion mixture to the oil can be used, such as pouring the conversion mixture formed in a first mixing vessel into the oil contained in a second vessel. The oil to which the conversion mixture is added can generally include any type of petroleum based oil, including used oil such as used motor oil. The used motor oil can be any grade of motor oil, including both single-grade and multi-grade motor oil. The used motor oil can also have any viscosity, as viscosity does not affect the products produced by the method described herein. The used motor oil can also include additives typically included in most motor oils, such as detergents, dispersants, corrosion inhibitors, and the like. The used motor oil can also be motor oil for any type of vehicle, including motor oil used in cars, motorcycles, buses, trucks, go-karts, snowmobiles, boats. Lawn mowers, agricultural and construction equipment, locomotives, and aircraft. The used motor oil suitable for use in embodiments described herein has typically undergone thermal and mechanical degradation such that the motor oil has been removed from the engine in which it was previously used. The embodiments described herein can also be used on new motor oil as well as general petroleum based oil and/or crude oil.

In some embodiments, the oil is filtered or screened prior to the conversion mixture being added to the oil. Filtering or screening is aimed at removing solid particulate, such as coke particles or metallic particles. In some embodiments, the oil is filtered to remove most or all particulate of 3 microns or larger. Any known filtering or screening equipment can be used to remove particulates from the oil.

In some embodiments, the conversion mixture is added to the oil such that the resulting mixture of conversion mixture and oil is from about 20 wt % to 80 wt % oil and from about 35 wt % to 65 wt % conversion mixture.

In process 120, the conversion mixture and the oil are heated and mixed to form a reaction mixture. The mixing and heating of the oil and the conversion mixture can take place in any vessel suitable for mixing and heating such components. In some embodiments, the vessel is a barrel having a heat source located underneath, inside of, and/or rolled the barrel and inside of which is a mixing device or into which a mixing device can be inserted. The mixing device is generally not limited, and may include, for example, a series of mixing paddles or blades that can be driven by an electrical motor or the like.

In some embodiments, the mixture of oil and the conversion mixture is heated to a temperature in the range of from 200° F. and 400° F., and more preferably to a temperature in the range of from 225° F. to 250° F. Once heated to a temperature within this range, the temperature is maintained for a period of time of 1 hour or more, and preferably within a range of from 1 hour to 3 hours. Any manner of heating the oil and reaction mixture can be used, such as through the use of a propane heating unit located under the vessel holding the oil and reaction mixture. In some embodiments, the heating process drives off water and alcohol (from the conversion mixture).

The mixing of the oil and the conversion mixture can take place during and/or after the desired temperature has been achieved. When mixing is carried out after the desired temperature has been achieved, the mixing can be carried out for the entire period of time during which the elevated temperature is maintained, for less than the entire period of time during which the elevated temperature is maintained, or intermittently during the time the elevated temperature is maintained. In some embodiments, the mixing device used is operated in the range of from 30 to 40 RPM.

In process 130, the reaction mixture produced in process 120 is cooled. Any suitable manner for cooling the reaction mixture, including letting the reaction mixture cool at ambient temperature, can be used. In some embodiments, the reaction mixture is cooled to a temperature less than 70° F. The cooling of the reaction mixture can take place over any period of time necessary to cool the reaction mixture below 70° F. When ambient temperature is used to cool the reaction mixture, the cooling process can take 8 hours or longer. When the cooling of the reaction mixture is forced, such as through the use of cooling system, the time to bring the reaction mixture below 70° F. will be substantially shorter.

In process 140, a high nitrate compound is added to the reaction mixture. The high nitrate compound is any nitrate compound having a high degree of reactivity. Any high nitrate compound suitable for use in rebuilding the hydrocarbons that were broken down in previous processes can be used. In some embodiments, the high nitrate compound is ethyl ammonium nitrate, ammonium nitrate, potassium nitrate, sodium nitrate, nitric acid and methanol in combination, or tetranitratoxycarbon, or any combination thereof. Any manner of adding the high nitrate compound to the reaction can be used, such as pouring the high nitrate compound into the vessel holding the reaction mixture. Once the high nitrate compound is added to the reaction mixture, the reaction mixture can be stirred to promote a homogenous mixture of all of the components. Any suitable manner of mixing the reaction mixture can be used, including the use of the mixing mechanism previously used to mix the conversion mixture and the oil.

In some embodiments, the amount of high nitrate compound added to the reaction mixture is such that the resulting mixture of high nitrate compound and reaction is from 60 wt % to 65 wt % reaction mixture and from 40 wt % to 45 wt % high nitrate compound.

In some embodiments, the high nitrate compound is added to an alcohol prior to being mixed with the reaction mixture. Any suitable alcohol can be used, with specific examples of alcohol/high nitrate compound pairs including ethanol and ammonium nitrate, ethanol and potassium nitrate, and ethanol and sodium nitrate. In some embodiments, the mixture of high nitrate compound and alcohol is from 70 to 85 wt % high nitrate compound and from 15 to 30 wt % alcohol. The combination of the high nitrate compound and the reaction mixture leads to an exothermic reaction. In some embodiments, the mixture of high nitrate compound and reaction mixture should be allowed to stand for a set period of time to allow the reaction to run to completion. In some embodiments, the exothermic reaction can take place for an hour or longer. When the exothermic reaction raises the temperature of the reaction mixture, the reaction mixture can also be allowed to cool after the exothermic reaction is completed. In some embodiments, the reaction mixture is allowed to cool to less than 70° F. Any manner of allowing the reaction mixture to cool can be used, including ambient cooling or forced cooling through use of cooling system.

In process 150, an amino acid is added to the reaction mixture. Any specific amino acid can be used in process 150. In some embodiments, preferred amino acids include taurine or methionine. Any manner of adding the amino acid to the reaction can be used, such as pouring the amino acid into the vessel holding the reaction mixture. When the amino acid is added to the reaction mixture, the reaction mixture can be stirred to help promote formation of a homogenous mixture. Any suitable manner of mixing the reaction mixture can be used: including the use of the mixing mechanism previously used to mix the conversion mixture and the oil.

The amount of amino acid added to the reaction mixture will generally control whether embodiments of the method described herein will convert the oil into diesel fuel or jet fuel. When the oil is to be converted to diesel fuel, the amount of amino acid added to the reaction mixture is such that the resulting mixture of amino acid and reaction is from 99.95 wt % to 99.99 wt % reaction mixture and from 0.01 wt % to 0.05 wt % amino acid. When the oil is to be converted to jet fuel, the amount of amino acid added to the reaction mixture is such that the resulting mixture of amino acid and reaction is from 99.990 wt % to 99.999 wt % reaction mixture and from 0.001 wt % to 0.01 wt % amino.

In process 160, the reaction mixture is ozonized, which generally includes bubbling ozone gas through the reaction mixture. Ozonizing can be used to help remove and/or separate sulfur from the reaction mixture. Any apparatus capable of bubbling ozone through the reaction mixture can be used. The rate of ozone bubbled through the reaction mixture is generally not limited, and in some embodiments can be bubbled through the reaction mixture at a rate of from 1 gm/hr to 5 gm/hr. The ozonizing process can be carried out for a period of time ranging from about 6 hours to 30 hours or more, and more preferably in the range of from about range around 22 to 26 hours.

During and/or after the ozonizing process, the reaction mixture can be cooled. In some embodiments, the reaction mixture is cooled to a temperature of about 30° F.

Once the ozonizing process is completed, the reaction mixture can generally be left to settle and phase separate. In some embodiments, the reaction mixture can be left to settle for 24 hours or longer. Generally speaking, the reaction mixture when left to settle will settle into a asphalt oil phase at the bottom, a diesel or jet fuel phase in the middle, and a sulfuric acid phase at the top. The settled reaction mixture may also include extraneous material at the very bottom of the vessel.

Once the reaction mixture has been allowed to settle, a process 170 of separating the phases of the settled reaction mixture can be carried out. Any method of separating the phases of reaction mixture can be used, such as decanting or skimming. In some embodiments, the sulfuric acid is collected off the top of the settled reaction mixture, which may require careful and precision skimming Once the sulfuric acid is removed, the fuel layer can be decanted or skimmed off of the asphalt oil layer at the bottom.

When embodiments of the method described herein are used to produce diesel fuel, the resulting diesel fuel has characteristics and qualities that compare favorably to diesel fuel produced through other methods, such as traditional refinery methods. For example, the normal alkane distribution of the diesel fuel compares favorably to the normal alkane distribution of traditionally produced diesel fuel. Diesel engine testing also confirms that the diesel fuel produced by the methods described herein compare favorably to diesel engine testing on traditionally manufactured diesel fuel. Further details of this testing is described below in the Examples.

Similar favorable results were obtained when comparing jet fuel produced by methods described herein to jet fuel produced by more traditionally refinery methods. Further details of this comparison are detailed below in the Examples. In some embodiments, the method described herein must be performed sequentially. That is to say, each component must be added in the order laid out above. Deviation from the sequence of adding different components to the oil can lead to less favorable results.

EXAMPLES

Example 1

A conversion mixture was formed by mixing together 43 ounces of methanol and 10 ounces of soda ash in a first vessel. The methanol and soda ash were mixed until the soda ash substantially dissolved in the methanol.

10 gallons of used motor oil was filtered to remove particulate 3 microns and larger. The filtered motor oil was then placed in a second vessel. The conversion mixture was poured into the second vessel holding the filtered used motor oil, and a propane beating unit located under the second vessel was ignited to begin the heating of the motor oil and the conversion mixture. The temperature of the used motor oil and conversion mixture was raised to 230° F. and maintained at this temperature for one hour. Mixing of the used oil and conversion mixture occurred periodically throughout the heating.

After 1 hour at 230° F., the mixture was allowed to cool at ambient temperature until the mixture reached a temperature of under 70° F. The cooling process took approximately 8 hours.

128 ounces of ethyl ammonium nitrate was poured into the second vessel, which resulted in an exothermic reaction taking place. The reaction was allowed to proceed for one hour. After 1 hour, the temperature of the mixture was taken, and the mixture was allowed to cook at ambient temperature until it again reached a temperature below 70° F.

14 ounces of taurine was added to the mixture, followed by bubbling ozone through the mixture using a spa ozone generator. The ozone was bubbled through the mixture for 24 hours.

After 24 hours, ozone bubbling was terminated and the mixture was allowed to settle for 24 hours. The mixture phase separated into predominantly three phases. The lowest phase was asphalt oil, the middle phase was diesel fuel, and the top phase was sulfuric acid. The sulfuric acid was collected off the top and set aside, followed by separating the diesel fuel from off the top of the asphalt oil phase.

Example 2

The same procedure as described in Example I was carried out, with the exception of adding 20 ounces of taurine. The phase separated mixture included a bottom phase of asphalt oil, a middle phase of jet fuel, and a top phase of sulfuric acid. The three phases were separated as described in Example 1.

Example 3

Diesel engine testing was conducted on the diesel and jet fuel phases collected in Examples I and 2. Performance and emissions of the two samples were tested and compared against performance and emissions tests on ultra low sulfur diesel (ULSD) and military grade JP-8. The tests were performed using a John Deere 6068H diesel engine operating at two different loads (nominally 700 N-m and 1000 N-m) at constant speed (1700 RPM). The John Deere engine was a 275 HP, 6.8 L, 6 cylinder, turbocharged, common-rail fuel injected diesel engine that meets EPA Tier 2 specification for off-road diesel engines.

At each of the two test conditions, fuel consumption was accurately measured using an A VL flow meter and exhaust gas measurements were made using a 5-gas emissions analysis system that includes chemiluminescence measurement of NO, NOz and total $NO_x$, flame ionization detection of total hydrocarbons and non-dispersive infrared detection of CO and C02. The results of these tests are shown in FIG. 2.

The results indicate that the engine operated normally using the Example 1 diesel fuel formulation (identified as Syn-Diesel in FIG. 2) and compared favorably with results of the engine operating on ULSD. Specifically, the brake specific fuel consumption (g/kw-hr), which is a measure of overall efficiency/fuel economy of the engine, was identical for the Example 1 diesel fuel and ULSD at the low load condition and increased by a nominal level of 0.8% at the high load condition. The latter increase is well within the experimental uncertainty. Similarly, the Example 2 jet fuel formulation (identified as Syn-Jet A in FIG. 2) performed comparably to JP-8 in the same engine in terms of brake specific fuel consumption.

The emissions results for both the Example 1 diesel fuel and Example 2 jet fuel were also comparable to that of ULSD and JP-8, respectively. Specifically, the Example 1 diesel fuel resulted in a decrease in brake specific NOR emissions ($g_{NOx}$/kw-hr) of 0.8% at the low condition and an increase of 0.4% at the high load condition in comparison to ULSD. The Example 1 diesel fuel resulted in a decrease in brake specific CO emissions ($g_{CO}$/kw-hr) of 7% at the low condition and an increase of 8% at the high load condition in comparison to ULSD. The Example 1 diesel fuel resulted in a decrease in brake specific unburned hydrocarbon emissions (pc/kw-hr) of 9% at the low condition and a decrease of 8% at the high load condition in comparison to ULSD.

In addition to fuels as an end product of petroleum oil conversion processes, long carbon chain molecules, commonly referred to as long chain carbons, are also valuable as an input (i.e., precursor) for use in a variety of petrochemical and/or pharmaceutical processes. Thus, various embodiments may take advantage of the presence of long chain carbons in the process to obtain long chain carbons from the petroleum based oil, which may also be described as converting petroleum based oil to long chain carbons.

Figure 3:
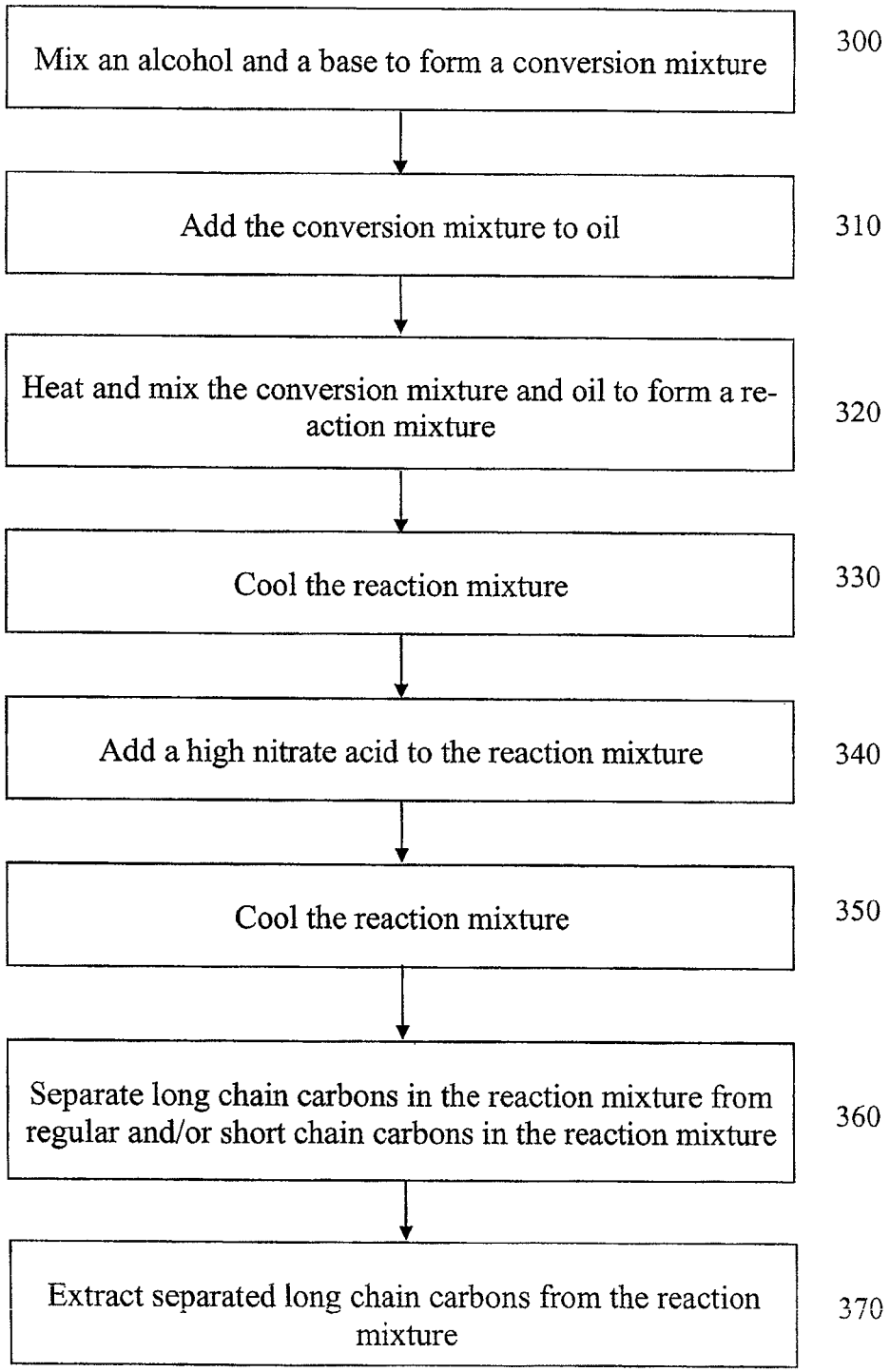
FIG. 3 is a flow chart detailing embodiments of a method for obtaining long chain carbons from oil as disclosed herein.

With reference to FIG. 3, a method to obtain long chain carbons from petroleum based oil is similar to the method to convert petroleum based oil into diesel fuel or jet fuel as disclosed in the discussion above with respect to FIG. 1. Specifically, method processes 100-140 shown in FIG. 1 may be performed as method processes 300-340 with the processes diverging after process 140/340 to obtain the long chain carbons. Accordingly, embodiments of a method for obtaining long chain carbons from petroleum based oil may include a process 300 of mixing an alcohol and a base to form a conversion mixture, a process 310 of adding the conversion mixture to oil, a process 320 of heating and mixing the conversion mixture and oil to form a reaction mixture, a process 330 of cooling the reaction mixture, a process 340 of adding a high nitrate compound to the reaction mixture, a process 350 of cooling the reaction mixture after the high nitrate reaction of process 340, a process 360 of separating the long chain carbons in the reaction mixture from the regular and/or short chain carbons in the reaction mixture, and a process 370 of extracting the separated long chain carbons form the reaction mixture. For the embodiments disclosed herein, used oil may be the oil chosen for processing, but the oil processed by the various embodiments may be one or a combination of petroleum based oil, crude oil, used oil, used motor oil, and new motor oil. When referring to oil herein it is with regard to petroleum based oil and not vegetable oils and/or other non-petroleum based oils.

As understood herein, long chain carbons refer to hydrocarbon molecules having longer hydrocarbon chains than standard jet fuel. Alternatively, long chain carbon molecules may also be described as hydrocarbon molecules having a hydrocarbon chain length in excess of 18.

In process 300, the conversion mixture is produced. Production of the conversion mixture generally includes mixing an alcohol and a base until the base is fully dissolved in the alcohol. Any method of mixing these two components can be used provided that the base fully dissolves in the alcohol. Similarly, any suitable mixing apparatus can be used for mixing the two components. Heat can be applied to the mixture during mixing as a means of promoting the dissolution of the base in the alcohol. If heat is added to promote dissolution, the conversion mixture should be allowed to cool back to room temperature before being added to the oil in process 110.

The alcohol used in process 300 can generally include any alcohol suitable for serving as a carrier for the base and in which the base can be fully dissolved. In some embodiments, the alcohol is methanol, ethanol, t-butanol, isopropanol, or butanol, or any combination thereof. In some embodiments, the alcohol is mixed with benzene.

The base used in process 100 can generally include any base suitable for weakening and/or breaking the bonds in the hydrocarbon chains of the petroleum based oil and which cancels out acidic components of the oil. In some embodiments, the base is soda ash, sodium carbonate, sodium hydroxide, baking soda, potassium hydroxide, or any combination thereof. Testing performed using sodium hydroxide has produced high quality results.

In some embodiments, the conversion mixture includes from 65 wt % to 90 wt % alcohol and from to wt % to 35 wt % base. In a preferred embodiment, the conversion mixture includes from 75 to 85 wt % alcohol and from 15 to 25 wt % base.

In some embodiments, the conversion mixture will be screened or filtered after the base has fully dissolved in the alcohol in order to remove any small particulates, such as metal filings, dried oil chunks, dirt, and miscellaneous deposits. Any method of screening or filtering can be used, and the screening or filtering will generally aim to remove any particulate having a size greater than 3 microns. The screening or filtering process is carried out before the conversion mixture is added to the oil.

In process 310, the conversion mixture is added to oil. Any manner of adding the conversion mixture to the oil can be used, such as pouring the conversion mixture formed in a first mixing vessel into the oil contained in a second vessel. The used oil to which the conversion mixture is added can generally include any type of petroleum based oil, including used oil such as used motor oil. The used motor oil can be any grade of motor oil, including both single-grade and multi-grade motor oil. The used motor oil can also have any viscosity, as viscosity does not affect the products produced by the method described herein. The used motor oil can also include additives typically included in most motor oils, such as detergents, dispersants, corrosion inhibitors, and the like. The used motor oil can also be motor oil for any type of vehicle, including motor oil used in cars, motorcycles, buses, trucks, go-karts, snowmobiles, boats. Lawn mowers, agricultural and construction equipment, locomotives, and aircraft. The used motor oil suitable for use in embodiments described herein has typically undergone thermal and mechanical degradation such that the motor oil has been removed from the engine in which it was previously used. The embodiments described herein can also be used on new motor oil as well as general petroleum based oil and/or crude oil.

In some embodiments, the oil is filtered or screened prior to the conversion mixture being added to the oil. Filtering or screening is aimed at removing solid particulates, such as coke particles or metallic particles. In some embodiments, the used oil is filtered to remove most or all particulate of 3 microns or larger. Any known filtering or screening equipment can be used to remove particulates from the oil.

In some embodiments, the conversion mixture is added to the used oil such that the resulting mixture of conversion mixture and used oil is from about 20 wt % to 80 wt % used oil and from about 35 wt % to 65 wt % conversion mixture.

In process 320, the conversion mixture and the used oil are heated and mixed to form a reaction mixture. The mixing and heating of the used oil and the conversion mixture can take place in any vessel suitable for mixing and heating such components. In some embodiments, the vessel is a barrel having a heat source located underneath, inside of, and/or rolled into the barrel and inside of which is a mixing device or into which a mixing device can be inserted. The mixing device is generally not limited, and may include, for example, a series of mixing paddles or blades that can be driven by an electrical motor or the like.

In some embodiments, the mixture of used oil and the conversion mixture is heated to a temperature in the range of from 200° F. and 400° F., and more preferably to a temperature in the range of from 225° F. to 250° F. Once heated to a temperature within this range, the temperature is maintained for a period of time of 1 hour or more, and preferably within a range of from 1 hour to 3 hours. Any manner of heating the used oil and reaction mixture can be used, such as through the use of a propane heating unit located under the vessel holding the used oil and reaction mixture. In some embodiments, the heating process drives off water and alcohol (from the conversion mixture).

The mixing of the oil and the conversion mixture can take place during and/or after the desired temperature has been achieved. When mixing is carried out after the desired temperature has been achieved, the mixing can be carried out for the entire period of time during which the elevated temperature is maintained, for less than the entire period of time during which the elevated temperature is maintained, or intermittently during the time the elevated temperature is maintained. In some embodiments, the mixing device used is operated in the range of from 30 to 40 RPM.

In process 330, the reaction mixture produced in process 320 is cooled. Any suitable manner for cooling the reaction mixture, including letting the reaction mixture cool at ambient temperature, can be used. In some embodiments, the reaction mixture is cooled to a temperature less than 70° F. The cooling of the reaction mixture can take place over any period of time necessary to cool the reaction mixture below 70° F. When ambient temperature is used to cool the reaction mixture, the cooling process can take 8 hours or longer. When the cooling of the reaction mixture is forced, such as through the use of cooling system, the time to bring the reaction mixture below 70° F. will be substantially shorter.

In process 340, a high nitrate compound is added to the reaction mixture. The high nitrate compound is any nitrate compound having a high degree of reactivity. Any high nitrate compound suitable for use in rebuilding the hydrocarbons that were broken down in previous processes can be used. In some embodiments, the high nitrate compound is ethyl ammonium nitrate, ammonium nitrate, potassium nitrate, sodium nitrate, nitric acid and methanol in combination, or tetranitratoxycarbon, or any combination thereof. Testing performed using ethyl ammonium nitrate has produced high quality results. Any manner of adding the high nitrate compound to the reaction can be used, such as pouring the high nitrate compound into the vessel holding the reaction mixture. Once the high nitrate compound is added to the reaction mixture, the reaction mixture can be stirred to promote a homogenous mixture of all of the components. Any suitable manner of mixing the reaction mixture can be used, including the use of the mixing mechanism previously used to mix the conversion mixture and the oil.

In some embodiments, the amount of high nitrate compound added to the reaction mixture is such that the resulting mixture of high nitrate compound and reaction is from 60 wt % to 65 wt % reaction mixture and from 40 wt % to 45 wt % high nitrate compound.

In some embodiments, the high nitrate compound is added to an alcohol prior to being mixed with the reaction mixture. Any suitable alcohol can be used, with specific examples of alcohol/high nitrate compound pairs including ethanol and ammonium nitrate, ethanol and potassium nitrate, and ethanol and sodium nitrate. In some embodiments, the mixture of high nitrate compound and alcohol is from 70 to 85 wt % high nitrate compound and from 15 to 30 wt % alcohol. The combination of the high nitrate compound and the reaction mixture leads to an exothermic reaction. In some embodiments, the mixture of high nitrate compound and reaction mixture should be allowed to stand for a set period of time to allow the reaction to run to completion. In some embodiments, the exothermic reaction can take place for an hour or longer.

In process 350, after the exothermic reaction raises the temperature of the reaction mixture, the reaction mixture is allowed to cool after the exothermic reaction is completed. In some embodiments, the reaction mixture is allowed to cool to less than 70° F. Any manner of allowing the reaction mixture to cool can be used, including ambient cooling or forced cooling through use of cooling system. The reaction mixture should be cooled to a temperature that a temperature where long chain carbons in the reaction mixture are at substantially equilibrium or greater relative to regular and/or short chain carbons in the reaction mixture. To achieve proper equilibrium it was found that the reaction mixture typically needed to reach a temperature substantially equal to or less than 70° F. The optimum temperature for long chain carbon creation appeared to be between 50° F. and 70° F., with particularly good results for the 50° F. to 60° F. range.

In process 360, the long chain carbons in the reaction mixture are separated from the regular and/or short chain carbons in the reaction mixture. The separation process may be performed using any many of separation processing applicable to separating long carbon chain molecules from shorter carbon chain molecules, including, but not limited to: atmospheric distillation, vacuum distillation, absorption processing, thermo cracking, and catalytic conversion.

In process 370, the separated long chain carbons are extracted from the reaction mixture. Some separation processes (i.e., process 360 described above) may inherently extract the long chain carbons as part of the separation process such that the extraction process 370 is not necessary. However, if the separation process 360 does not inherently extract the long chain carbons from the reaction mixture, but only divides the mixture so that extraction is possible, the long chain carbons should be extracted in a manner appropriate to the separation processing. Once the long chain carbons are extracted/separated, the long chain carbons can be used as an input (i.e., precursor) to additional petrochemical and/or pharmaceutical processing.

Testing has shown the above described methodology for obtaining long chain carbons from petroleum based oils to be an inexpensive and efficient method for obtaining long chain carbons for use in petro-chemical and/or pharmaceutical processing. Analysis of the reaction mixture indicates the presence of a large amount of hydrocarbon chains larger than 18 in length, with many larger than 25 in length.

In some embodiments, the method described herein must be performed sequentially. That is to say, each component must be added in the order laid out above. Deviation from the sequence of adding different components to the oil can lead to less favorable results.

Various embodiments may perform automatic processing of the oil into fuels and/or long chain carbons. Various embodiments may employ computer based controllers to automatically operate controllers in response to automatic sensors measuring temperatures, times, or other parameters indicative of process operation. Various embodiments may provide the control and management functions via an application operating on a computer system (or other electronic devices). Embodiments may be provided as a computer program product which may include a computer-readable, or machine-readable, medium having stored thereon instructions which may be used to program/operate a computer (or other electronic devices) or computer system to perform a process or processes in accordance with the present invention. The computer-readable medium may include, but is not limited to, hard disk drives, floppy diskettes, optical disks, Compact Disc Read-Only Memories (CD-ROMs), Digital Versatile Disc ROMS (DVD-ROMs), Universal Serial Bus (USB) memory sticks, magneto-optical disks, ROMs, random access memories (RAMs), Erasable Programmable ROMs (EPROMs), Electrically Erasable Programmable ROMs (EEPROMs), magnetic optical cards, flash memory, or other types of media/machine-readable medium suitable for storing electronic instructions. The computer program instructions may reside and operate on a single computer/electronic device or various portions may be spread over multiple computers/devices that comprise a computer system. Moreover, embodiments may also be downloaded as a computer program product, wherein the program may be transferred from a remote computer to a requesting computer by way of data signals embodied in a carrier wave or other propagation medium via a communication link (e.g., a modem or network connection, including both wired/cabled and wireless connections).

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

As used herein, spatial or directional terms, such as "left," "right," "front," "back," and the like, relate to the subject matter as it is shown in the drawing Figures. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc., used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

In addition, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of I and the maximum value of 10; that is, all subranges beginning with a minimum value of 1 or more and ending with a maximum value of 10 or less (e.g., 5.5 to 10, 2.34 to 3.56, and so forth) or any values from] to 10 (e.g., 3, 5.8, 9.9994, and so forth).

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method for converting petroleum based oil to diesel fuel or jet fuel, the method comprising:

mixing an alcohol and a base to form a conversion mixture, said base being a base suitable for weakening and/or breaking bonds in hydrocarbon chains of said petroleum based oil and which cancels out acidic components of said petroleum based oil;

adding said conversion mixture to said petroleum based oil to form a reaction mixture;

heating said reaction mixture to a temperature of between 200° F. and 400° F. for a period of at least 1 hour, cooling said reaction mixture to a temperature less than 70° F.;

adding a high nitrate compound to said reaction mixture;

adding an amino acid to said reaction mixture;

ozonizing said reaction mixture; and separating said reaction mixture into sulfuric acid, diesel fuel or jet fuel, and asphalt oil.

2. The method of claim 1 wherein said petroleum based oil is at least one of a group consisting of: crude oil, used oil, used motor oil, and new motor oil.

3. The method of claim 1 wherein said mixing of said alcohol and said base to form said conversion mixture is performed until said base is fully dissolved in said alcohol.

4. The method of claim 1 wherein said mixing of said alcohol and said base to form said conversion mixture further comprises:

heating said conversion mixture during said mixing of said conversion mixture; and cooling said conversion mixture to substantially room temperature before adding said conversion mixture to said petroleum based oil to form said reaction mixture.

5. The method of claim 1 wherein said conversion mixture includes from 65 wt % to 90 wt % alcohol and from 10 wt % to 35 wt % base.

6. The method of claim 1 further comprising filtering said conversion mixture before adding said conversion mixture to said petroleum based oil to form said reaction mixture.

7. The method of claim 1:

wherein said alcohol is at least one of a group consisting of: an alcohol suitable for serving as a carrier for said base in which said base can be fully dissolved, methanol, ethanol, t-butanol, isopropanol, butanol, and an alcohol mixed with benzene;

wherein said base is at least one of a group consisting of: soda ash, sodium carbonate, sodium hydroxide, baking soda, and potassium hydroxide;

wherein said high nitrate compound is at least one of a group consisting of: a nitrate compound having a high degree of reactivity suitable for use in rebuilding hydrocarbons, ethyl ammonium nitrate, ammonium nitrate, potassium nitrate, sodium nitrate, nitric acid and methanol in combination, and tetranitratoxycarbon; and wherein said amino acid is at least one of a group consisting of: taurine and methionine.

8. The method of claim 1 further comprising filtering said petroleum based oil before adding said conversion mixture to said petroleum based oil to form said reaction mixture.

9. The method of claim 8 wherein said filtering of said petroleum based oil removes particulates 3 microns or larger.

10. The method of claim 1 wherein said heating of said reaction mixture to a temperature of between 200° F. and 400° F. is performed for a period of between 1 hour and 3 hours.

11. The method of claim 1 wherein said process of adding said high nitrate compound to said reaction mixture includes from 60 wt % to 65 wt % of said reaction mixture and from 40 wt % to 45 wt % of said high nitrate compound.

12. The method of claim 1 further comprising adding said high nitrate compound to an alcohol to form an alcohol/high nitrate compound pair prior to adding said high nitrate compound to said reaction mixture.

13. The method of claim 12 wherein said alcohol/high nitrate compound pair is from 70 wt % to 85 wt % high nitrate compound and 15 wt % to 30 wt % alcohol.

14. The method of claim 12 wherein said alcohol/high nitrate compound pair wherein said alcohol is at least one of a group consisting of: ethanol and ammonium nitrate, ethanol and potassium nitrate, and ethanol and sodium nitrate.

15. The method of claim 1 further comprising allowing said reaction mixture to set for a period of time after adding said high nitrate compound to said reaction mixture to allow a reaction of said high nitrate compound and said reaction mixture to run to completion.

16. The method of claim 15 further comprising allowing said reaction mixture to cool to less than 70° F. after allowing said reaction of said high nitrate compound and said reaction mixture to run to completion and prior to adding said amino acid to said reaction mixture.

17. The method of claim 1 wherein said process of adding amino acid to said reaction mixture includes from 99.95 wt % to 99.99 wt % of said reaction mixture and from 0.01 wt % to 0.05 wt % of said amino acid such that diesel fuel is produced.

18. The method of claim 1 wherein said process of adding amino acid to said reaction mixture includes from 99.990 wt % to 99.999 wt % of said reaction mixture and from 0.001 wt % to 0.01 wt % of said amino acid such that jet fuel is produced.

19. The method of claim 1 wherein said ozonizing of said reaction mixture bubbles ozone gas through said reaction mixture at a rate of 1 gm/hr to 5 gm/hr for a period of time between 6 hours and 30 hours.

20. The method of claim 1:

wherein said ozonizing of said reaction mixture bubbles ozone gas through said reaction mixture at a rate of 1 gm/hr to 5 gm/hr for a period of time between 6 hours and 30 hours; and wherein said reaction mixture is cooled to 30° F. after ozonizing of said reaction mixture and prior to separating said reaction mixture into said sulfuric acid, said diesel fuel or jet fuel, and said asphalt oil; and said method of claim 1 further comprises leaving said reaction mixture to settle for a period of time after ozonizing of said reaction mixture and prior to separating said reaction mixture into said sulfuric acid, said diesel fuel or jet fuel, and said asphalt oil wherein said period of time to settle after ozonizing lasts for at least 24 hours.

* * * * *